United States Patent [19]

Hilliard

[11] Patent Number: 4,804,218

[45] Date of Patent: Feb. 14, 1989

[54] SCUBA TANK HARNESS

[76] Inventor: Dan J. Hilliard, 14015 Chestnut Dr., Apartment F, Eden Prairie, Minn. 55344

[21] Appl. No.: 63,812

[22] Filed: Jun. 19, 1987

[51] Int. Cl.[4] ..... B65D 63/18

[52] U.S. Cl. ..... 294/31.2; 294/157

[58] Field of Search ..... 294/31.2, 149, 150, 294/152, 153, 154, 156, 157, 165; 190/115

[56] References Cited

U.S. PATENT DOCUMENTS

| | | | |
|---|---|---|---|
| 3,708,045 | 1/1973 | Katz | 190/115 |
| 4,489,815 | 12/1984 | Martinez et al. | 190/107 X |
| 4,545,414 | 10/1985 | Baum | 190/115 X |
| 4,556,245 | 12/1985 | Gruenwald | 294/31.2 |
| 4,592,091 | 5/1986 | Italici | 190/115 X |
| 4,700,818 | 10/1987 | Orwin | 294/157 X |
| 4,754,996 | 7/1988 | Tecca et al. | 294/31.2 X |

*Primary Examiner*—Robert P. Swiatek

*Attorney, Agent, or Firm*—Orrin M. Haugen; Thomas J. Nikolai; Frederick W. Niebuhr

[57] ABSTRACT

The present invention relates to an apparatus for carrying air tanks of the type typically used by underwater scuba divers. More particularly, the present invention relates to a harness used to transport such tanks to or from a boat, a car or a vendor used to fill such tanks with air.

8 Claims, 2 Drawing Sheets

FIG. 1
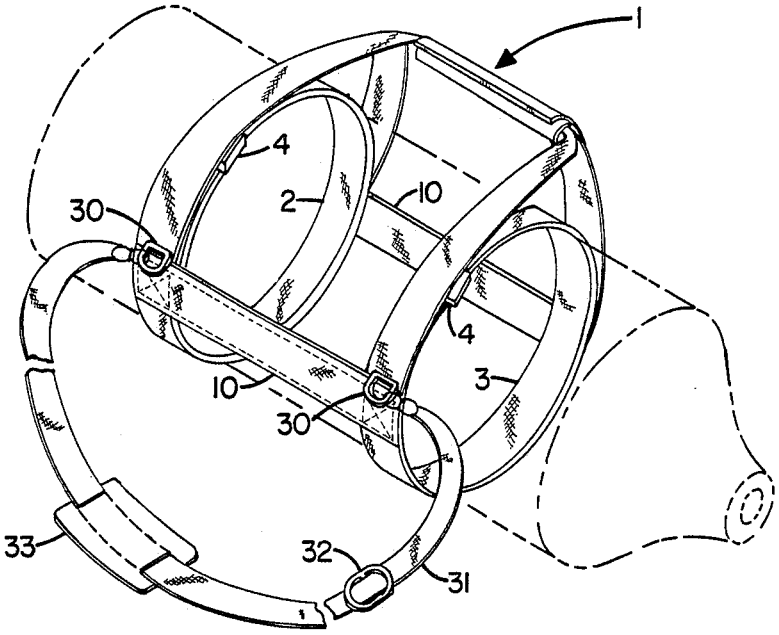
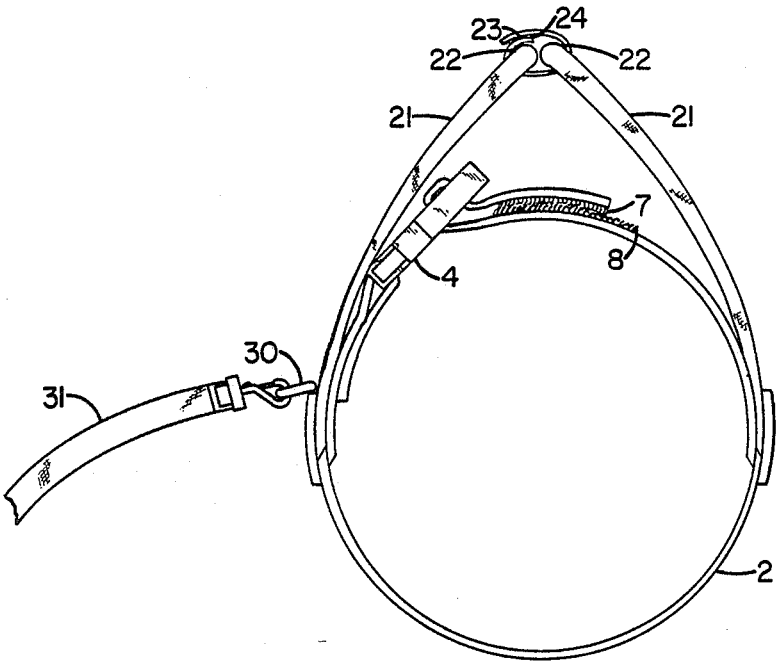
FIG. 2

SCUBA TANK HARNESS

BACKGROUND OF THE INVENTION

In recent years, scuba diving has become of very popular recreational activity. In order to make the sport enjoyable to wide a variety of people, scuba equipment designers have generally directed their attention toward to developing equipment which can be comfortably worn in the water. However, such equipment can be difficult to transport and/or store because it is often bulky and awkward to carry. This particularly true with respect to the air tanks used by scuba divers. Such tanks can weigh up to 45 pounds.

A number of companies presently sell sacks or duffle type bags for carrying scuba equipment. Such bags, however, are awkward to use in transporting tanks because the tanks tend shift within the bag. As a result, there is real need in the art for a harness assembly which can be easily fastened to a scuba tank and can be used to carry the tank from point to point outside of the water.

SUMMARY OF THE INVENTION

The present invention is directed to a harness which can be adjusted to fit tanks of various sizes. The harness includes two straps intended to surround the tank. These straps have an adjustable length. Secured to the opposite end of each of these straps respectively is the male and female portion of a clip type buckle. These buckles permit the tank to be quickly locked in or removed from the harness.

The harness of the present invention also includes a handle means that is attached to each of the two straps. This design, thus, provides a comfortable and secure means for holding the tank. Further, the design of the present invention includes a shoulder type strap in addition to the handle so that the tank can easily be carried comfortably, whether full or empty, even over long distances.

The principal object of the present invention is to provide a harness for transporting a scuba tank from point to point outside of the water.

Another object of this invention is to provide such a harness apparatus for a scuba tank which is adjustable so that it will fit various sized scuba tanks.

Still another object of the invention is to provide a harness for a scuba tank which fits tightly to the scuba tank so that the scuba tank will not slip, slide or shift inside of the harness.

An additional objective of the present is to provide a scuba harness with a handle which allows the user to comfortable carry the scuba tank from point to point.

Still another object of the invention is to provide a harness of the type described above which includes a shoulder strap which, in combination with a handle, can be used to transport the tank comfortably, whether full or empty, for some distance.

These and other objects of the present invention will become more clear from a reading of the description of the preferred embodiments set forth below in conjunction with the drawings in which like numbers have been assigned to like parts in the various views.

DESCRIPTION OF THE DRAWINGS

FIG. 1 is a perspective view of the harness of the present invention as it would be used to carry a scuba tank;

FIG. 2 is end view showing the harness of the present invention as it would be assembled around the tank;

DESCRIPTION OF THE PREFERRED EMBODIMENT

Figure 3:
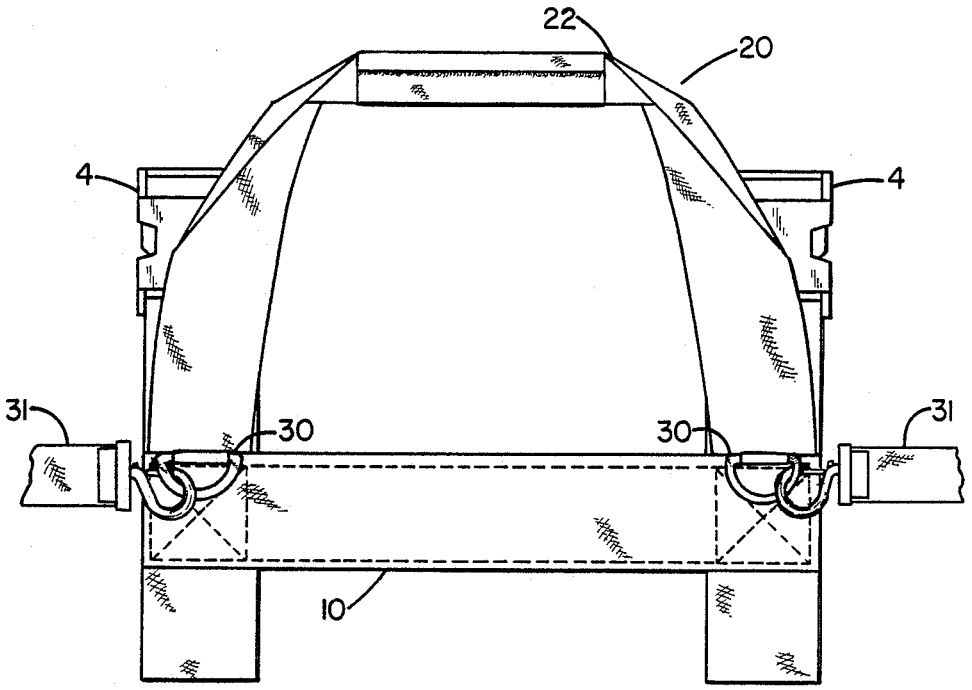
FIG. 3 is a side view of the harness of the present invention as it would be fitted around the tank.
Figure 4:
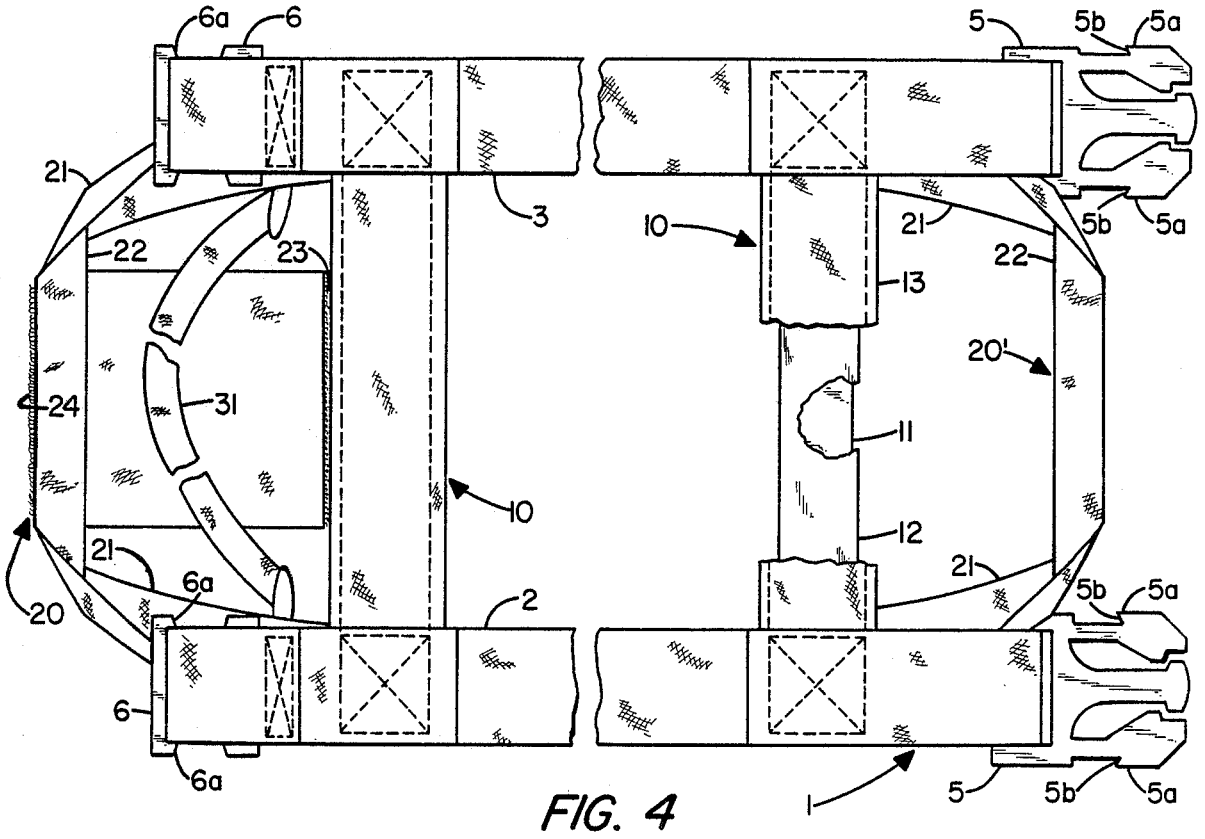
FIG. 4 is a top view of the harness of the present invention before it is snapped around a scuba tank.

Turning first to FIG. 4 of the drawings, shown is the harness 1 of the present invention. Harness 1 includes straps 2 and 3 which are intended to surround the scuba tank as shown in FIG. 1. Associated with each of straps 2 and 3 is a buckle 4 having a male member 5 and a female member 6. A male member 5 of a buckle 4 is secured to one end of each of straps 2 and 3. A female member 6 of the buckle 4 is secured to the opposite end of each of straps 2 and 3. The male member 5 of each buckle is intended to mate with the female member 6 so that each of straps 2 and 3 form a loop axially surrounding the tank.

Preferably, at least the male member 5 of each buckle will be made of a plastic which will permit the catches 5*a* to be compressed inwardly when the male member 5 is to be put into or removed from the female member 6. Otherwise the catches are intended to be in a non-compressed state. When the male member 5 is inside the female member 6 and the catches 5*a* are in their non-compressed state, members 5 and 6 are locked together by engagement of the surfaces 6*a* with the respective surfaces 5*b*. To unlock members 4 and 5, all one need do is squeeze the elements 5*a* until surfaces 5*b* and 6*a* no longer are engaged and then pull members 5 and 6 apart.

FIG. 2 best shows the means by which the female portions 6 of the buckle 4 are secured to the end of straps 2 and 3. Attached to the end of straps 2 and 3 associated with the female member 6 of the buckle 4 is a section of material 7 which forms one half of Velcro-type closure. The other half of the Velcro-type closure 8 is sewn to the same side of straps 2 and 3 a short distance from the end. Straps 2 and 3 can then be looped around a cross-member (not shown) of the female member 6 of the buckle and back over itself so that the two portions 7 and 8 of the Velcro closure can mate. The length of straps 2 and 3 can be adjusted by changing the area of mating between the portions 7 and 8 of the Velcro closure.

Returning again to FIG. 4, also shown are two support straps 10 which each have opposite ends thereof sewn to straps 2 and 3 respectively. To provide additional support, these straps have a metallic core 11 which is surrounded by a pad 12, preferably made out of plastic, which has been sewn into the cover material 13 of the straps 10.

FIG. 4 also shows a pair of handle members 20 and 20' which are also sewn at their opposite ends to straps 2 and 3. Each handle member 20 has a pair of flexible members 21 which run between the point where they are attached to straps 2 and 3 and a rigid member 22. In the preferred embodiment, the rigid member 22 is constructed of a $\frac{3}{8}$ inch diameter stiff, plastic dowel which is wrapped in the same material of which the flexible members 21 are made.

As shown in FIG. 2, the rigid member 22 of handle member 20 has attached to it a strap 23. Secured to one side of strap 23 near one end is the female half of the Velcro closure 24. The male half of Velcro closure 24 is secured to the opposite side of strap 23 near its opposite end. Thus, when contructed, the two handle members 20 and 20' are brought together, strap 23 can be wrapped around rigid members 22. The male and female portions of closure 24 can then be mated so that the two handle members 20 and 20' are held together to form a single handle which is comfortable to the user.

The present invention also includes a pair of D-shaped buckles 30, one associated with strap 2 and the other associated to strap 3. Buckles 30 are present so that opposite ends of a shoulder strap 31 can be attached to the harness. A wide variety of conventional attachment means can be used to make this attachment. Further, the strap 31 can include buckle 32 for adjusting the length of the strap 31 as well as a shoulder pad 33 which is slidably attached to the strap 31.

To use the harness of the present invention, the user lays the harness out as shown in FIG. 4. He then centers the tank on the harness. Then he brings the two ends of strap 2 and the two ends of strap 3 together so that the male and female buckle membmers 5 and 6 mate. Should the user find that the harness straps 2 and 3 are either too long or too short for the particular tank he or she wishes to carry, as described above, the length can be adjusted by re-positioning the area of mating between portions 7 and 8 of the respective Velcro closure. The user then brings the two handle portions together and joins them using strap 23 and the Velcro closure 24 associated with strap 23. Finally, the user slips the shoulder strap 31 over his or her shoulder and/or grips the rigid members 22 of the handle to transport the tank in a very convenient, effective manner.

What is claimed is:

1. A unitary harness for carrying an elongated tank comprising:

(a) first and second flexible straps, each having a first end and a second end;

(b) means for adjusting the effective length of said flexible straps;

(c) first and second buckle means for securing the first and second ends of each of said flexible straps together when said straps are wrapped around said tank;

(d) a pair of semi-rigid support straps, each having one end thereof secured to said first flexible strap and the second end thereof secured to said second flexible strap intermediate the first end and the second end of said flexible straps so that said pair of semi-rigid support straps and said first and second flexible straps form a web;

(e) handle means for carrying said harness, said handle means including a pair of handle members, each handle member having opposite ends secured to said first and second flexible straps so that said handle means and said web will support said tank even if said first and second buckle means should fail causing said first and second ends of said flexible straps not to be secured together.

2. The apparatus of claim 1 wherein said handle means includes a central rigid member.

3. The apparatus of claim 1 wherein each of said first and second buckle means includes a female member secured to one end of the associated flexible strap and a male member secured to the opposite end of said associated flexible strap.

4. The apparatus of claim 3 wherein said male member has a pair of compressible catches having locking surfaces intended to engage associated locking surfaces of the female member when said male member is inside the female member and said catches of the male member are in their non-compressed state.

5. The apparatus of claim 1 wherein said semi-rigid straps have a core made of a stiff material and a fabric cover surrounding said core.

6. The apparatus of claim 1 wherein said means for adjusting the effective length of said flexible straps include one-half of a Velcro-closure attached to one side of each of said flexible straps and the other half of said Velcro closure attached to the same side of each of said flexible straps a short distance from the end of each strap.

7. The apparatus of claim 1 further including:

(a) a shoulder strap;

(b) means for securing one end of said shoulder strap to said first flexible strap and the opposite end of said shoulder strap to the second flexible strap; and (c) means for adjusting the length of said shoulder strap strap.

8. The apparatus of claim 7 further including a shoulder pad slidably attached to said shoulder strap.

* * * * *